United States Patent [19]

Middleby

[11] 4,263,756

[45] Apr. 28, 1981

[54] BUILDING ELEMENT

[75] Inventor: David M. Middleby, Hamilton, Australia

[73] Assignee: D.S.R. Developments Pty. Limited, Hamilton, Australia

[21] Appl. No.: 47,730

[22] Filed: Jun. 12, 1979

[51] Int. Cl.[3] ..... E04D 13/00

[52] U.S. Cl. ..... 52/11; 52/732

[58] Field of Search ..... 52/11, 16, 15, 95, 732

[56] References Cited

U.S. PATENT DOCUMENTS

| | | | |
|---|---|---|---|
| 2,950,787 | 8/1960 | Walsh | 52/732 |
| 3,805,460 | 4/1974 | Middleby | 52/16 |
| 4,092,808 | 6/1978 | Maloney, Jr. et al. | 52/11 |

FOREIGN PATENT DOCUMENTS

| | | | |
|---|---|---|---|
| 683196 | 3/1964 | Canada | 52/11 |

*Primary Examiner*—Price C. Faw, Jr.
*Assistant Examiner*—Carl D. Friedman
*Attorney, Agent, or Firm*—Albert L. Jeffers; John F. Hoffman

[57] ABSTRACT

A building element for use on a building having roof supporting rafters which extend outwardly from the wall alignment of the building has an eaves cover panel portion adapted to provide an eaves cover of the building and to be attached to the building and has integrally formed therewith an upstanding outer wall along one side, the outer wall being the outer wall of a channel shaped gutter section. The opposite inner wall of the gutter section is provided by a separate wall portion which is mountable during assembly on a co-operating mounting portion of the eaves cover panel portion. This arrangement permits ease of manufacture, nesting of the components for transportation and storage and easy and speedy of building operations. Preferably an integral downwardly projecting channel is provided in the eaves panel portion and the wall portion is a fit such as a press fit into the recess and maybe bonded therein.

6 Claims, 7 Drawing Figures

Fig 3
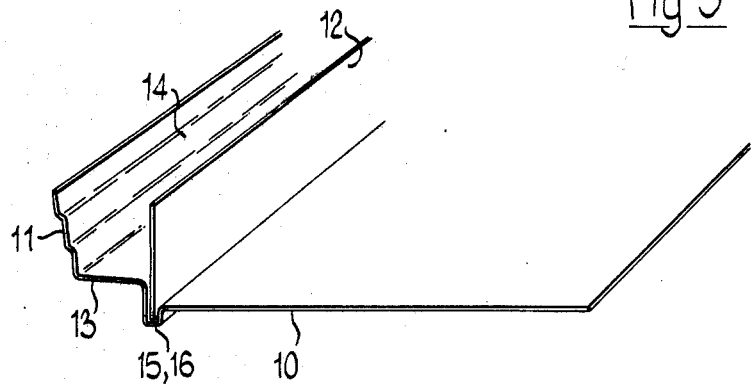
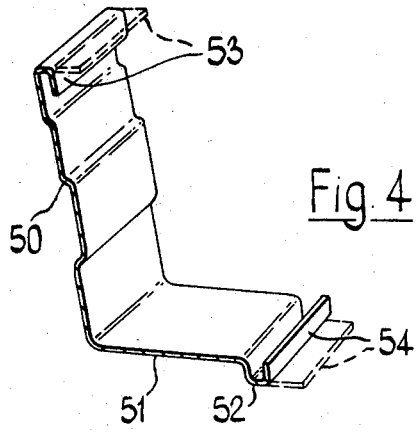
Fig. 4
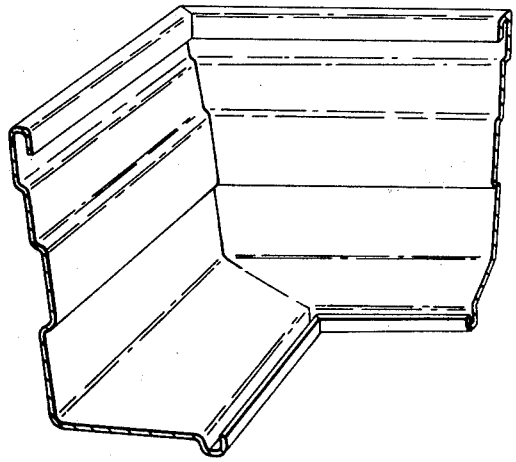
Fig. 5

BUILDING ELEMENT

FIELD OF THE INVENTION

The present invention relates to a building element and more particularly is concerned with a structure which, when assembled, constitutes an integral guttering and eaves covering for attachment to the edge of the roof of a building. The integral structure is made to a suitable length for the application in question.

PRIOR ART

The building element of the present invention is concerned with the general type of structure the subject of U.S. Pat. No. 3,805,460 (David Michael Middleby). This patent discloses a building element comprising an eaves cover panel length which is formed along one edge thereof with an integral channel-shaped gutter section. The building element is formed as an integral structure and is, in practice, delivered to a building site as such. This presents something of a problem to the manufacturer and/or user because, due to the configuration of the element, lengths of the element cannot be nested one within another. This makes transportation expensive due to the limited number of element lengths which can be conveyed at any one time in a given space.

OBJECT OF THE INVENTION

The present invention seeks to avoid the problem inherent in the prior art structure by providing a building element which may be transported as a two part element and conveniently be assembled at the site of proposed usage.

SUMMARY OF THE INVENTION

Broadly, the present invention is directed to a multipart building element which, when assembled, is suitable for mounting to a building having roof supporting rafters which extend outwardly from the wall alignment of the building; the building element comprising:

(a) an eaves cover panel length portion formed along one edge thereof with an integral portion which, in assembly of the element, forms an outer wall of a channel-shaped gutter section, and (b) a separate wall length portion which is mountable to the eaves cover panel length portion and which, when so mounted, forms an inner wall of the gutter section.

The separate wall length portion is preferably mounted to the eaves cover panel length portion by way of a recess formed in the eaves cover panel and extending along the length thereof parallel to the outer wall. The separate wall length portion may be held captive in the recess by being a press fit therein, upon assembly being effected, but is preferably held captive by bonding or crimping. When, in accordance with a preferred arrangement of the invention, the building element parts are made, at least in part, from a synthetic resin material, a bonding agent would normally be employed, but in the case of one or other or both of the parts being made from metal, their assembly may be effected by crimping.

The recess for the separate wall portion is preferably located in or defined by a lip which extends downwardly from a lower face of the eaves cover panel length portion. Such lip would then constitute an abutment to prevent water migrating back from the outer edge of the eaves cover panel portion and toward the wall of the building.

BRIEF DESCRIPTION OF THE DRAWINGS

The invention will be more fully understood from the following description of the preferred embodiment taken in conjunction with the accompanying drawings wherein:

FIG. 3 shows a perspective view of an alternatively shaped building element, FIGS. 4 and 5 show connector elements which are suitable for interconnecting adjacent linear and intersecting lengths respectively of the building element shown in FIG. 1, and FIGS. 6 and 7 show typical arrangements for mounting the building element of FIG. 1 to the roof line of a timber-framed and full-brick building respectively.

DETAILED DESCRIPTION OF THE DRAWINGS

Figure 1:
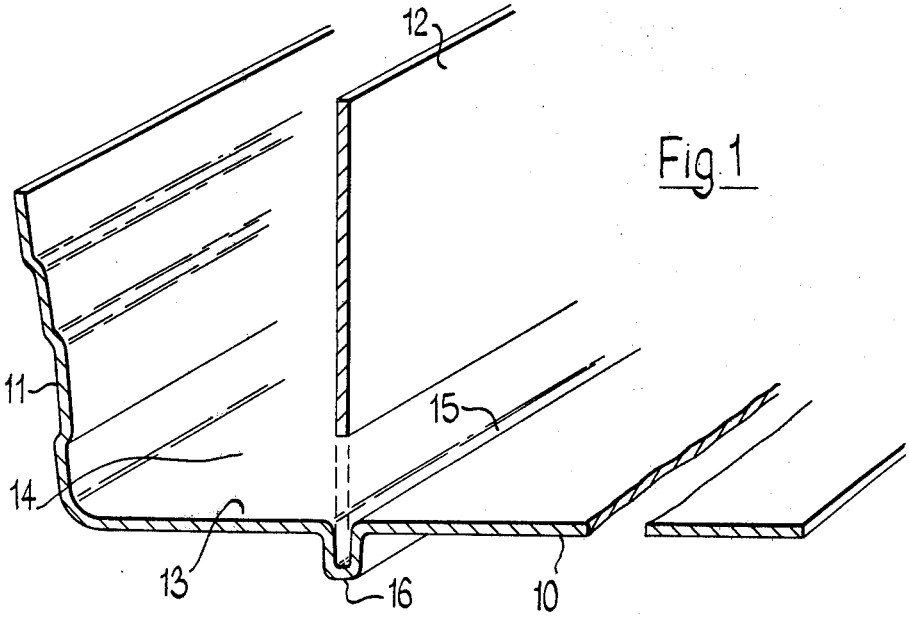
FIG. 1 shows a perspective view of the building element with the portions thereof separated.

As illustrated, the building element comprises an eaves cover panel length portion 10 (referred to in this description as an "eave panel"), an integrally formed outer wall portion 11, and a separately formed inner wall portion 12. Following assembly of the building element components, the inner and outer wall portions 11 and 12 co-operate, together with an intermediate portion 13 of the eave panel 10, to define a channel-shaped gutter section 14.

The two separate portions of the building element are produced (for delivery to a building site) in predetermined lengths, e.g. 5 meter lengths, and are assembled at the site of usage.

The eaves panel 10, including the integral outer wall portion 11, is roll formed, moulded, or pressed using a suitable material. This may be sheet metal or a glass fibre reinforced plastics material, but a preferred material is an acrylic coated A.B.S. plastics material which is manufactured under the trade mark CYCOLAC by Marbon Chemicals Limited. The separate inner wall portion 15 is preferably composed of a strip of the same material, but may be formed from another material.

On-site assembly of the inner wall portion 12 to the eave panel 10 is facilitated by locating the wall portion 12 in a pre-formed recess 15 in the eave panel. The recess is sized to be a press fit against the wall portion 12 and, when the two interconnecting portions are manufactured from plastics material, they are permanently joined using a suitable bonding agent.

The recess 15 is defined by a lip 16 which extends below the under surface of the eave panel 10 and which forms an abutment to any water which tends to flow around the outer surface of the guttering 14. Thus, the lip functions to prevent water migrating back toward the wall of a building to which the element is fitted.

The outer wall 11 of the guttering is shaped, as shown in FIG. 1, with longitudinal flutes for aesthetic reasons. The inner wall 12 of the gutter when mounted to the eave panel 10 has a height not less than the outer wall 11, to prevent any buildup of water from flowing back into the roofline of a building to which the element is fitted.

Figure 2:
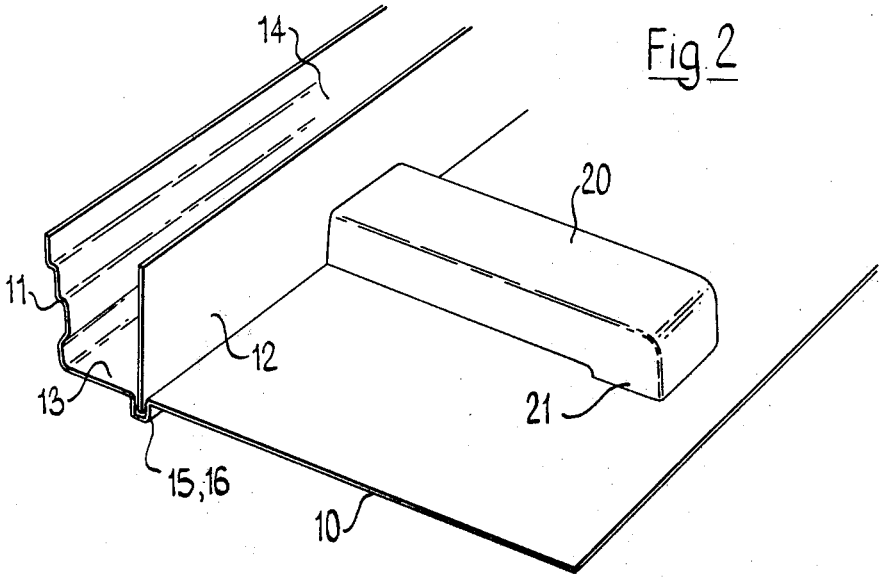
FIG. 2 shows a perspective view of the building element fitted with a downpipe coupling element.

The base portion 13 of the guttering may be formed at spaced intervals along its length with downwardly projecting sleeves (not shown) for connecting to downpipes. However, in a preferred construction, as shown in FIG. 2, a downwardly sloping sleeve or channel 20 is provided to extend through a cut-out 21 in the eave panel 10 of the element for connection with a downpipe, not shown. The sleeve 20 opens into the guttering 14 through the inner wall 12 of the guttering. The sleeve 20 is formed from plastics material and it is glued or otherwise bonded to the inner wall 12 of the guttering.

A modified form of the building element is shown in FIG. 3 and wherein the base portion 13 of the guttering is not co-planar with the remaining portion 10 of the eave panel.

Figure 6:
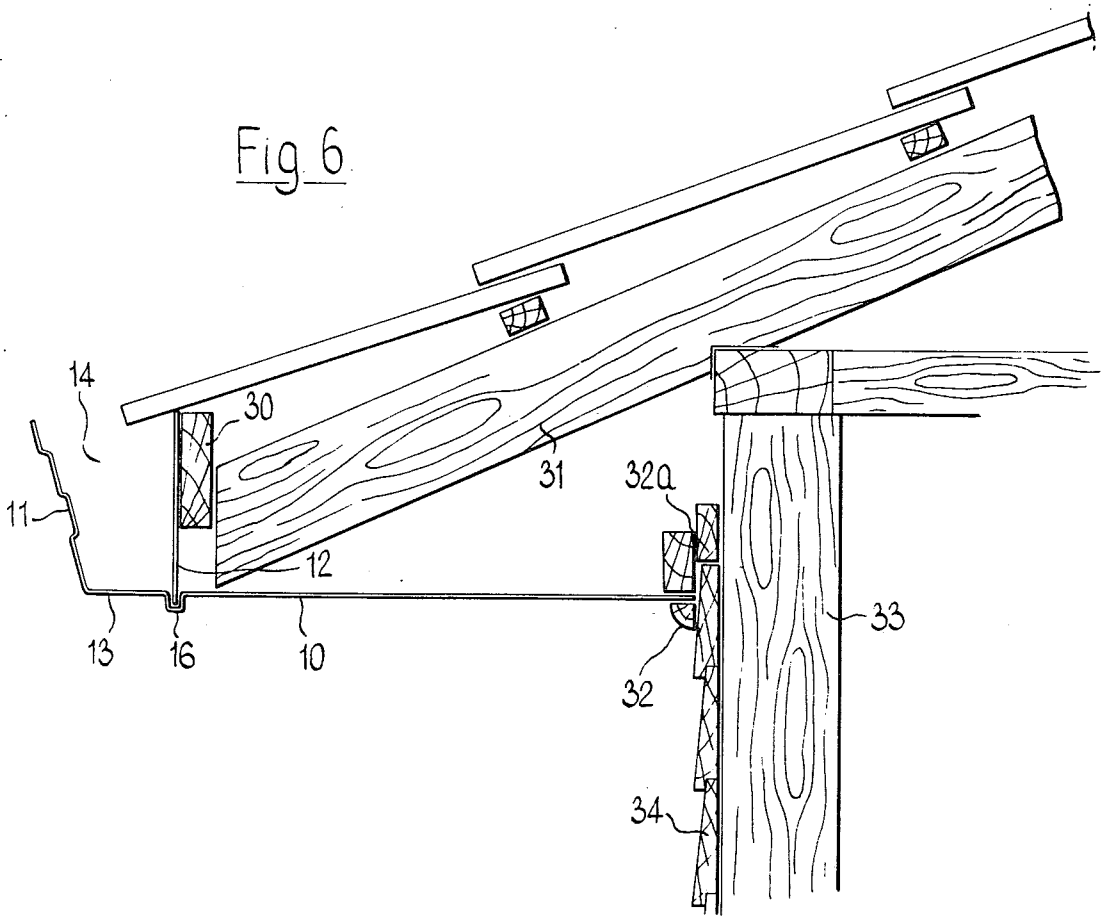
Figure 7:
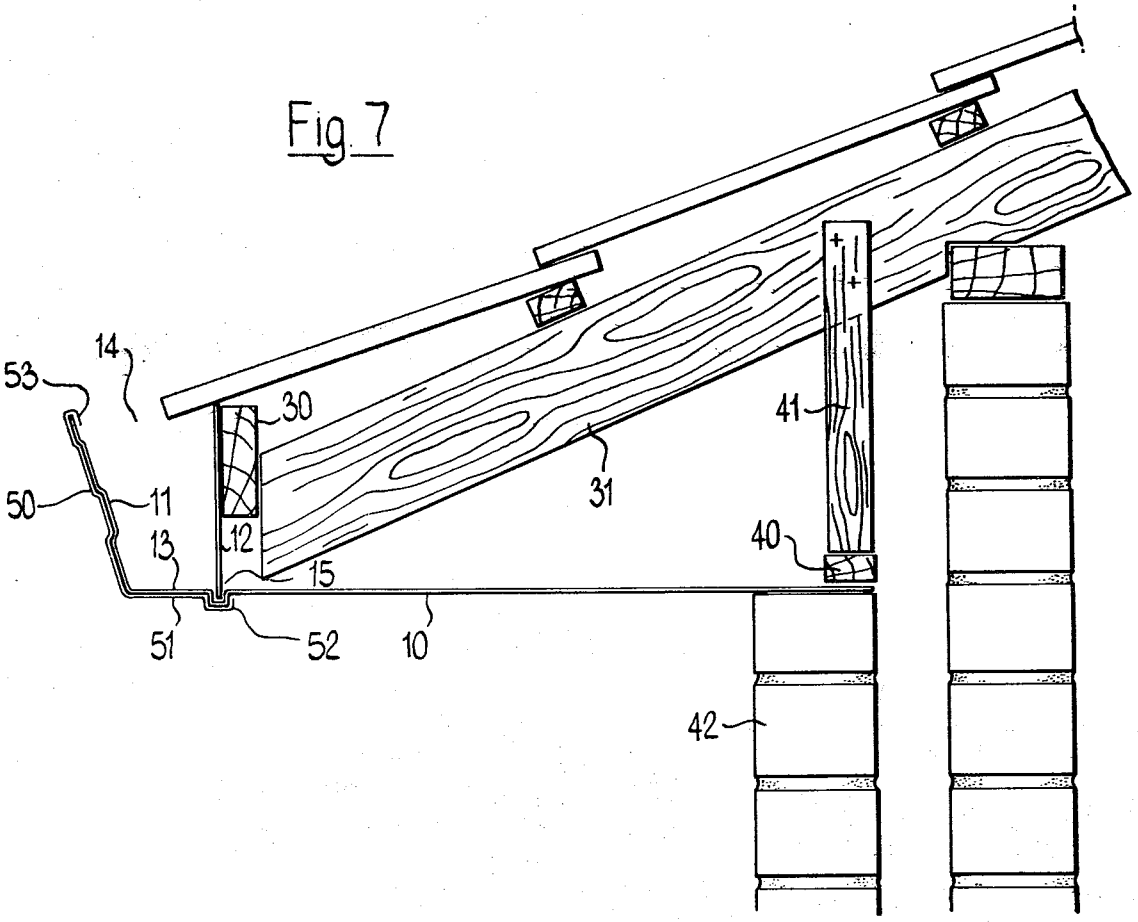

Reference is now made to FIGS. 6 and 7 of the drawings which show typical mounting arrangements of the building element:

In the case of a timber framed house structure, as shown in FIG. 6, the inner wall 12 of the guttering is screw or nail mounted to a tilting batten 30 which is in turn secured to the free end of the roof rafters 31. The inner margin of the eave panel 10 is then mounted by way of a timber moulding 32 to the underside of a support batten 32*a* which is secured to wall studs 33. Timber cladding 34 is attached to the studs 33 in the usual way.

In the case of a full-brick type structure, as shown in FIG. 7, the inner margin of the eave panel 10 is screw or nail mounted to the underside of a batten 40 which is in turn supported from the roofing rafters by a hanger 41. A similar construction is adopted in the case of a brick veneer type structure. In both the brick veneer and full brick type structures the inner margin of the eave panel 10 is concealed by the outer brick wall 42.

Although not shown as such in the drawings, the inner wall 12 of the guttering may be formed as an inverted L-shaped element with the shorter leg of such element being arranged to fit over and rest upon the upper edge of the tilting batten 30 shown in FIGS. 6 and 7 of the drawings.

To permit on-site interconnection of adjacent lengths of the assembled building element, a connector element as shown in FIG. 4 may be employed.

This comprises a pressed-metal or cast-metal element which has a shape corresponding to the profile of the outer wall 11, base portion 13 and lip 16 of the building element. Thus, the connector element has a wall portion 50, a base portion 51 and a channel portion 52 which locates around the lip 16 of the building element. Also, the connector element has a return flange 53 which is arranged to locate around the upper margin of the outer wall 11 of the building element. The return flange 53 and the wall 54 of the channel portion 52 would first be disposed in the positions shown by the dotted outlines in FIG. 4 and later be folded around the respective mating parts of the building element, when fitting the connector element. Alternatively, the connector element may be formed from a resilient material, such as sheet metal or a plastics material, and the portions 53 and 54 may be fitted about the mating parts of the building element by deforming the portions against their inherent resilience.

When connecting two adjacent lengths, their respective ends are butted together and are adhered by use of a suitable adhesive. The connector element is then fitted around the butt-joint and is secured to the building element by an adhesive/sealant, such as a silicone rubber sealant. FIG. 7 of the drawings shows a connector element mounted to the building element.

A similar connector element is employed for connecting together two intersecting building elements at the corner of a roof line. In this case, the adjacent building element lengths are end-mitered and a corner connector of a type shown in FIG. 5 is fitted.

Before securing the connector element to adjacent building element lengths, an H-section joining piece (not shown) may be fitted between the eaves cover panel portions 10 of the adjacent elements so as to lap and conceal the gap between the elements.

I claim:

1. A building element comprising: an eaves cover panel length portion formed along one side with an integral wall portion adapted, when in use, to be upstanding and to form an outer wall of a channel-shaped gutter section; said eaves cover panel length portion having a recess formed therein, said recess extending parallel to the outer wall; and a separate inner wall having an edge portion received in said recess such that it forms an opposite upstanding wall of the channel-shaped gutter section; said building element, when assembled, being suitable for mounting to a building having roof-supporting rafters which extend outwardly from a wall alignment of the building to provide an eaves covering and gutter.

2. A building element as claimed in claim 1 wherein the separate wall portion has a portion which is a press fit into said recess whereby it is held captive.

3. A building element as claimed in claim 1 wherein the separate wall portion is adapted to be bonded into the recess.

4. A building element as claimed in claim 1 wherein said recess is defined by a channel shaped downwardly projecting portion integrally formed with the eaves cover panel length portion.

5. A building element as claimed in claim 1 wherein the eaves cover panel length portion is formed from a plastics material.

6. A building element as claimed in claim 5 wherein the separate wall length portion is also formed from a plastics material.

* * * * *